United States Patent [19]

Pfannschmidt

[11] 4,436,292

[45] Mar. 13, 1984

[54] SYSTEM FOR THE TREATMENT OF A CONTINUOUS METAL WEB

[75] Inventor: Martin Pfannschmidt, Heiligenhaus, Fed. Rep. of Germany

[73] Assignee: SMS Schloemann-Siemag AG, Düsseldorf, Fed. Rep. of Germany

[21] Appl. No.: 363,836

[22] Filed: Mar. 31, 1982

[30] Foreign Application Priority Data

Feb. 24, 1981 [DE] Fed. Rep. of Germany ..... 3106811
Apr. 9, 1981 [DE] Fed. Rep. of Germany ..... 3114412

[51] Int. Cl.[3] ..... C21D 9/56; C23D 1/02

[52] U.S. Cl. ..... 266/107; 266/112; 432/59; 148/156; 118/68; 427/321

[58] Field of Search ..... 266/102, 103, 107, 111, 266/112, 120; 118/65, 67, 68, 672; 432/59; 148/153, 155, 156; 427/320, 321

[56] References Cited

U.S. PATENT DOCUMENTS 3,877,684 4/1975 Kurihara et al. ..... 266/112
4,143,184 3/1979 Paulus et al. ..... 427/300
4,154,432 5/1979 Janatka et al. ..... 266/104

FOREIGN PATENT DOCUMENTS 30614 6/1981 European Pat. Off. ..... 266/103

*Primary Examiner*—L. Dewayne Rutledge
*Assistant Examiner*—Christopher W. Brody
*Attorney, Agent, or Firm*—Watson, Cole, Grindle & Watson

[57] ABSTRACT

A system for the treatment of continuous metal webs facilitates both continuous annealing and hot-dip coating operations interchanging from annealing to a combined annealing and coating, and vice-versa. The system has an annealing station common to both operations as well as web feed and discharge sections and web entry storage and web discharge storage stations associated therewith.

13 Claims, 4 Drawing Figures

SYSTEM FOR THE TREATMENT OF A CONTINUOUS METAL WEB

BACKGROUND OF THE INVENTION

This invention relates generally to a system for the continuous and uninterrupted treatment of a continuous metal web through a web feed station, a web entry storage station, an annealing station, a hot-dip coating station.

A known system for the continuous annealing of a continuous metal web includes an apparatus having a web feed end with web uncoilers, a web cleaning device, a web entry storage station, an annealing station and a web discharge storage station followed by a web discharge station with web recoilers. At the annealing station, the web is guided in the path of a loop via driven deflector rollers and is first heated to a maximum annealing temperature of 900° C. This temperature is maintained for a predetermined period of time for the microstructure formation of the metal. Subsequently, the web is cooled down to ambient temperature in stages at the end of the annealing operation and emerges therefrom to enter the following web discharge storage or accumulator station. After the treated web has been moved through this station, it is subjected to an after-treatment, for example, by permitting it to pass through what is known as a skin-pass mill stand to effect a very light cold rolling. And, the after-treatment may include a stretch leveling device through which the treated strip passes before it is alternately wound into coils by a pair of recoilers.

Such a system for the continuous annealing of webs has a high output but is quite expensive, and only a limited number of qualified operators are available to operate the system to full capacity over long periods of time, i.e., several months running. However, the continuous operation of the plant without extended downtime is a requisite condition for its profitable utilization at the limit of its capacity. Also, for manufacturing purposes and for purposes of the production run, it is necessary that operation of such a costly system not be interrupted, since the frequent heating and cooling at the annealing station which occurs during such an interruption presents a drawback, since each start-up results in web rejection on a quality basis and results in start-up problems.

Another known system for the continuous annealing and hot-dip galvanizing of metal webs has an annealing station and a hot-dip galvanizing station downstream thereof in the direction of web movement. And, a web entry storage station is located upstream of the annealing station, and a web discharge storage station as well as a web after-treatment station are located downstream of the galvanizing station. Upstream of the web feed station uncoilers and a strip cleaning device are provided. At the discharge end, in addition to skin passing and stretcher leveling, the web is further subjected to after-treatment by chromate coating before the galvanized web is routed to the recoilers.

This system, also, only functions economically if it can be operated continuously for long periods of time without interruption. However, this is only made possible for operators of these expensive hot-dip galvanizing systems which must be operated at the limit of their capacity in order to optimize resource loading.

For those operators of hot-dip galvanizing systems who cannot optimize resource loading, it is necessary to shut down the system for a predetermined period from time to time. Thus, the repeated shut down and start-up of such a system is unprofitable and disadvantageous from a technical point of view. And, each new start-up of such a hot-dip galvanizing system leads to web rejection on a quality basis and to start-up problems.

SUMMARY OF THE INVENTION

It is therefore an object of the present invention to provide a system for the continuous and uninterrupted treatment of a continuous metal web which can be optimally and economically operated as a multi-purpose system both for the continuous annealing of the steel web and for the combined annealing and hot-dip coating of the web.

This objective is achieved according to the invention by arranging the hot-dip coating system between the annealing station and the web discharge station or the web discharge storage station, such that the hot-dip coating station can be effectively uncoupled from the annealing and discharge stations to effect a continuous web annealing operation, and can be selectively coupled in place to effect a combined continuous annealing and hot-dip coating operation. In such manner, when changing from hot-dip coating to continuous annealing, the hot-dip coating station can first be uncoupled from the annealing station and from the discharge end whereupon the annealing station can be coupled to the discharge end. And, when changing from continuous annealing to hot-dip coating, the hot-dip coating station can again be coupled to the annealing station and to the discharge end.

Other objects, advantages and novel features of the invention will become more apparent from the following detailed description of the invention when taken in conjunction with the accompanying drawings.

DETAILED DESCRIPTION OF THE INVENTION

Figure 1A:
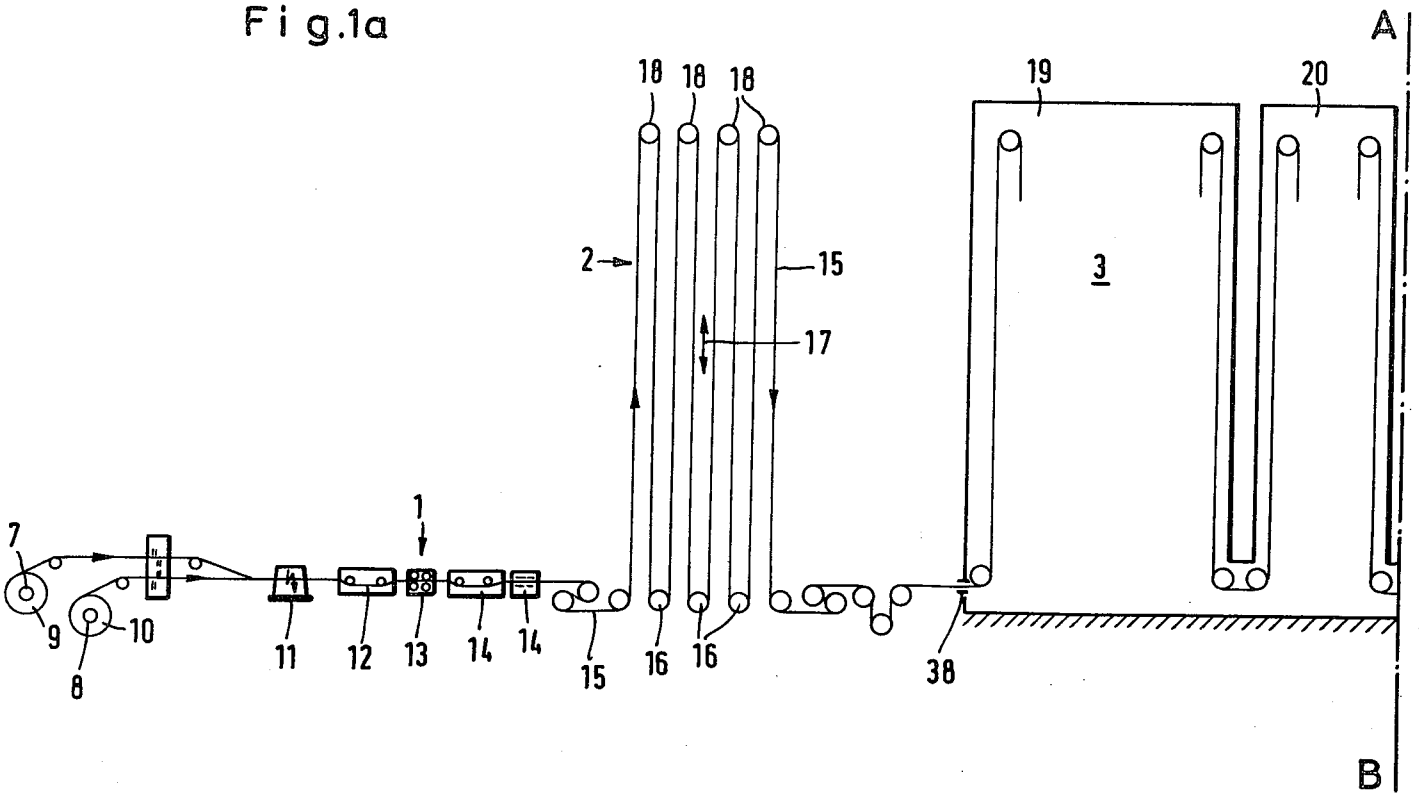
FIGS. 1*a* and 1*b* are schematic views of a web treatment system according to the invention, the injunction between the Figures lying along the plane A-B.
Figure 1B:
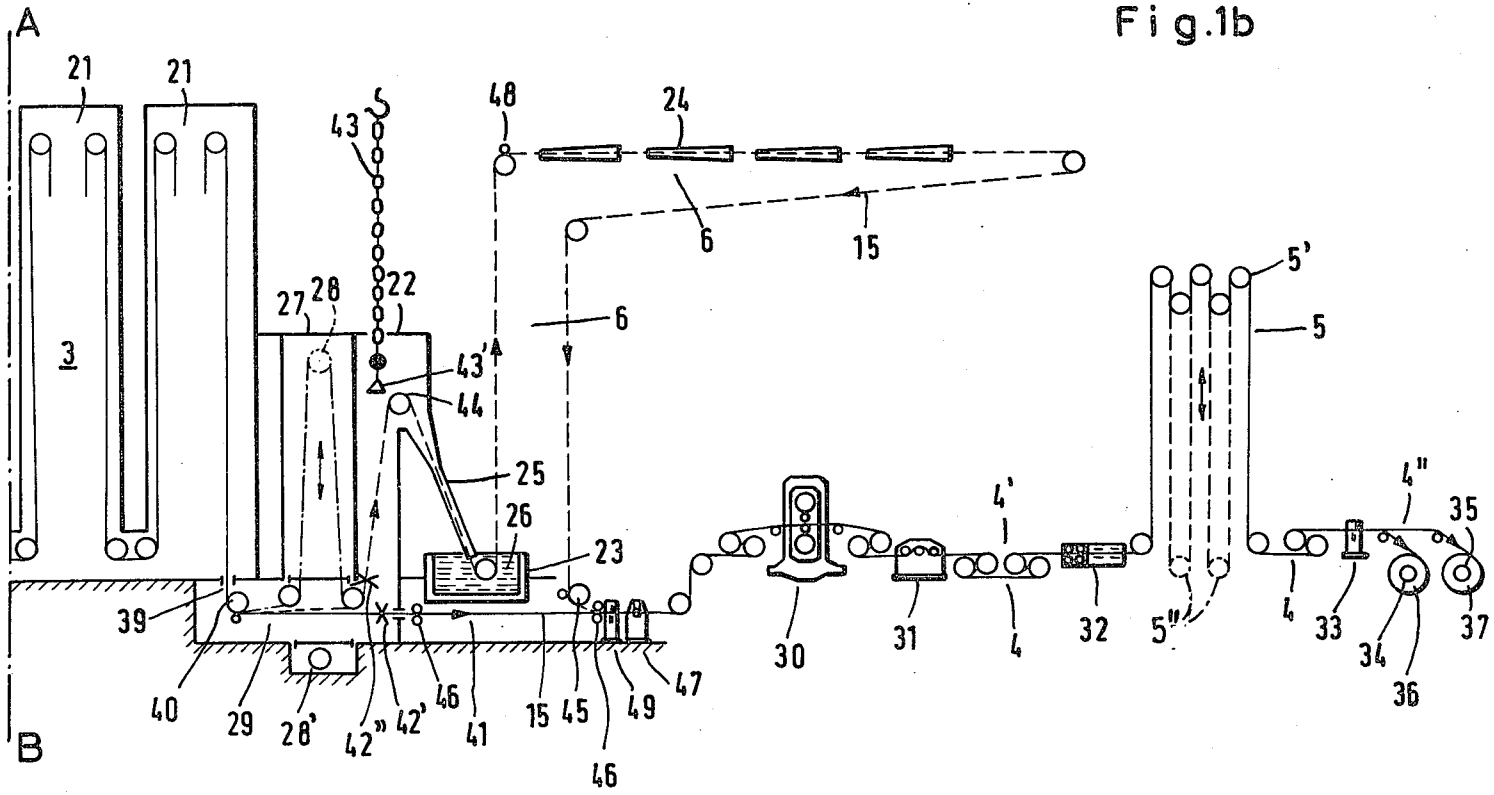

Turning now to the drawings wherein like reference characters refer to like and corresponding parts throughout the several views, the system shown in FIGS. 1*a* and 1*b* is arranged for the continuous annealing of a continuous metal web as well as for the annealing and hot-dip coating, such as galvanizing, of the web. The system includes an apparatus having a feed end 1 defining a web feed station, a web entry storage station 2, an annealing station 3, a web discharge station 4, a web discharge storage station 5, and a galvanizing station 6. A pair of uncoilers 7 and 8 having winding coils 9 and 10 are mounted on the apparatus at the feed end for unwinding one web after the other from the winding coils or reels as in the normal manner. After one reel is unwound, the unwinding of the next reel proceeds and is welded along the trailing end of the first unwound web by a welding device 11, and the web is cleaned for the following treatment as it passes through devices 12, 13 and 14. Web 15 then passes through web storage station 2 which includes a plurality of fixedly mounted lower deflector rollers 16 and a plurality of upward deflector rollers 18 which are vertically movable in the direction of double arrow 17 for storing a greater or lesser run of the web depending on the demands during the web treatment operation. Annealing station 3 includes a furnace of conventional design and comprises a front heating section 19, a central holding section 20 and a rear cooling section 21.

Galvanizing station 6 comprises a heating or cooling tower 22 and a zinc boiler pot 23 as well as a secondary cooling section 24. Connected to tower 22 is a downwardly sloping snout 25 which extends into a zinc bath 26 located in zinc boiler pot 23. Heating and cooling means (not shown) are arranged in the wall of tower 22. Such means may include heating devices, for example burners, which are turned on in order to raise the web to be galvanized to a zinc bath temperature of 450° C. upon completion of the coupling process. Moreover, if the web temperature for the following galvanizing operation is too high, the cooling system provided in the wall of the heating and cooling tower serves to regulate the ideal temperature for the following galvanizing operation.

A web storage or accumulator device 27 is located between annealing station 3 and cooling tower 22, the device including a storage roller 28 which is vertically movable in the direction of the double arrow between its solid and phantom outline positions along some suitable guide track not otherwise shown. During normal operation, i.e., during a continuous annealing operation or during a combined annealing and hot-dip coating operation, the roller is located at its lowermost position at 28' beneath an extension channel 29 provided between the annealing and coating stations. The discharge station or discharge end 4 located downstream of annealing station 3 and of hot-dip galvanizing station 6 includes, in front section 4', several strip treatment devices such as a skin-pass mill stand 30, a stretch leveling unit 31 and a chromizing after-treatment device 32, the latter being used only when galvanizing the web. Located at a rear section 4" is a cross-cutting shear 33 and, lying downstream thereof, a pair of recoilers 34 and 35 for rewinding the finished web alternately into coils or reels 36 and 37. In other words, after the web or a portion thereof is rewound into reel 36, for example, it is cross-cut by shear member 33 and is then rewound into reel 37.

The web discharge storage station 5 functions as a web accumulator and is essentially the same as the entry web storage station 2. Station 5, in the FIG. 1 embodiment, is located at the discharge end between sections 4' and 4". Thus, while alternating the rewinding of the web between reels 36 and 37, strip-treatment devices 30, 31 and 32 need not be stopped since lower movable deflector rollers 5" at station 5 are moved vertically upwardly to compensate for the shortened loop path of the web while the web continues to pass through the after-treatment devices. During the normal operation, the web is looped around only upper fixed deflector rollers 5', and during a reel change the web is looped around both the upper and lower deflector rollers as shown in dashed outline.

When annealing a steel web continuously for the first time, web 15 is unwound alternately from coilers 7 and 8, and web sections are welded at their respective trailing and leading edges by welding device 11 is cleaned as it passes through devices 12, 13 and 14 and is moved into web entry storage station 2. After several deflections, web 15 enters annealing station 3 at an entry point 38 and is heated in heating section 19 up to a normalization temperature of 900° C. The temperature is maintained in holding section 20 at this level for a predetermined period of time, whereafter web 15 is cooled down to ambient temperature in stages in cooling section 21 with holding times. Web 15 emerges from section 21 at a point 39 and, after deflection over roller 40, moves along a horizontal path through extension channel 29 beneath zinc boiler pot 23 in the direction of arrow 41 toward the discharge station. Here, it is first fed over deflector and S-rollers to skin-pass mill stand 30 and, if required, also to stretch leveling device 31. The chromizing after-treatment device 32 will be inoperatable since the metal web is not subjected to a galvanizing operation. After moving through discharge storage station 5, and cutting shear 33, the web is wound alternately into coils 36 and 37.

When changing for the first time from continuous annealing to hot-dip galvanizing, web 15 is cooled down in cooling section 21 to a zinc bath temperature of only about 450° C. and then emerges from the annealing station at point or discharge end 39. In order to deflect web 15 into galvanizing station 6, it is necessary to transversely cut the web. This is conveniently carried out at a position 42' with a manually operated shear. The leading end of the web thus formed at the cut and located in extension channel 29 is then welded manually on a triangular support 43', after the support connected to a gravity-type chain 43 has been lowered by a crane. The triangular support and the connected leading end of the web are then raised via the chain in heating or cooling tower 22 while the web is continually being slackened as at station 2. The leading end is then guided above a deflector roller 44 mounted on tower 22, and through zinc snout 25 to zinc bath 26. After being separated from the chain, the leading end is passed between a driven deflector roller 48 and its back-up roll, is threaded through secondary cooling section 24 by the crane, and finally emerges after passing between a driven deflector roller 45 and its back-up roll.

In the interim, the trailing end of the web formed at the cut is moved from separating position 42' by means of driving units 46 to a stitching or welding unit 47 so as to be positioned there. Driving units 46 may comprise a spaced pair of opposed drive rolls with a support run therebetween. Now, the leading end of the web which was passed through the galvanizing section remains at the level of a deflector roller 45 and is moved into stitching or welding machine 47 by the driven deflector rollers 45 and 48 and is thereby connected with the trailiing end of the web. The web can now be hot-dipped galvanized as it passes through the galvanizing section, is then subjected to the chromizing after-treatment at 32 as it moves through the discharge station and is alternately rewound into reels by recoilers 34 and 35.

And, in accordance with the invention, the web may by-pass the galvanizing station so as to reconvert the combined annealing and coating operations solely into a continuous web annealing operation. Before changing from hot-dip galvanizing to continuous annealing, the storage roller of web storage unit 27 is moved from its lower position at 28' to its upper position at 28 thereby looping the web within the storage unit as shown in phantom outline so as to effectively store a portion of the running web therein. The web is then transversely cut at position 42" by a manually operated shear and the trailing end of the web thus formed is pulled through tower 22, through zinc snout 25 and through boiler pot 23 by the driven deflector rollers 48 and 45 and by the devices at the discharge station until this trailing end is stopped at about 2 meters above the zinc boiler pot whereupon the web downstream of tower 22 is safely away from the zinc bath. The web is then transversely cut by shear member 49 so that the trailing end thus formed is held by welding or stitching machine 47. The leading end of the web remaining in extension channel 29 after cutting at position is now moved by means of driving unit 46 to machine 47 while taking up the web supply in storage unit 27 with web movement being stopped at station 3. The storage roller is thus moved back to its position at 28'. The leading end of the web is then connected to the trailing end of the web located at machine 47, and the web can be continuously annealed in the aforedescribed manner, while galvanizing station 6 with the cut web remaining therein has been effectively uncoupled and by-passed.

Now, if the annealed web is to be again hot-dipped galvanized in accordance with the present system, galvanizing station 6 must be effectively recoupled into the path of web travel. For this purpose, the storage roller of storage unit 27 is moved again from its position at 28' to its position at 28 so as to form a web loop within unit 27 as shown in phantom outline. The web is then cross-cut with a manually operated shear at position 42' and the leading end of the web thus formed is welded in the aforedescribed manner on triangular support 43' and is pulled up in heating or cooling tower 22 by the crane while the web is continually being taken up from storage unit 27 as deflector roller 28 is lowered. The leading end of the web is passed over deflector roller 44, through snout 25 and through zinc bath 26 until it reaches that end of the web section which remains about 2 meters above the boiler in the galvanizing station. The mating ends may then be welded together utilizing the triangular work support 43' after which such support is removed. The other web connection is carried out in the manner described earlier by moving the trailing end of the web remaining at position 42' by means of driving units 46 to machine 47 and positioning it there. Then, that end of the web section which remained in the galvinizing station at the position of deflector roller 45 is moved into machine 47 by means of deflector rollers 48 and 45 so as to be connected there with the trailing end of the cut web.

In the system illustrated in FIGS. 2*a* and 2*b*, web feed station 1, web entry storage station 2 and annealing stations 3 correspond to like station described with reference to FIGS. 1*a* and 1*b*. However, an elevator 51 is provided between annealing station 3 and a web discharge storage station 50 for threading web 15.

Figure 2A:
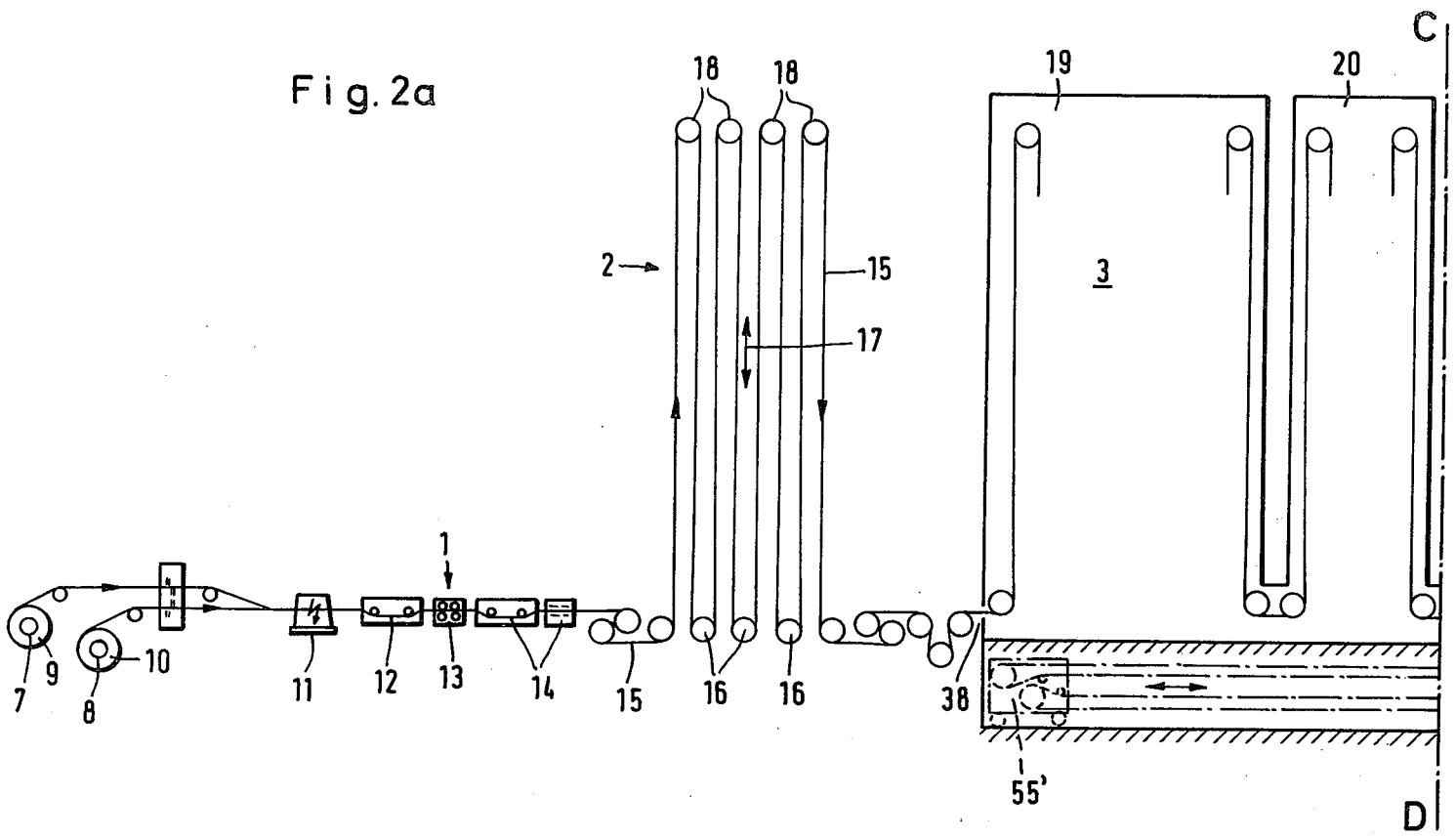
FIGS. 2*a* and 2*b* are schematic views of another embodiment of a web treatment system according to the invention, with the junction between these Figures lying along plane C-D.
Figure 2B:
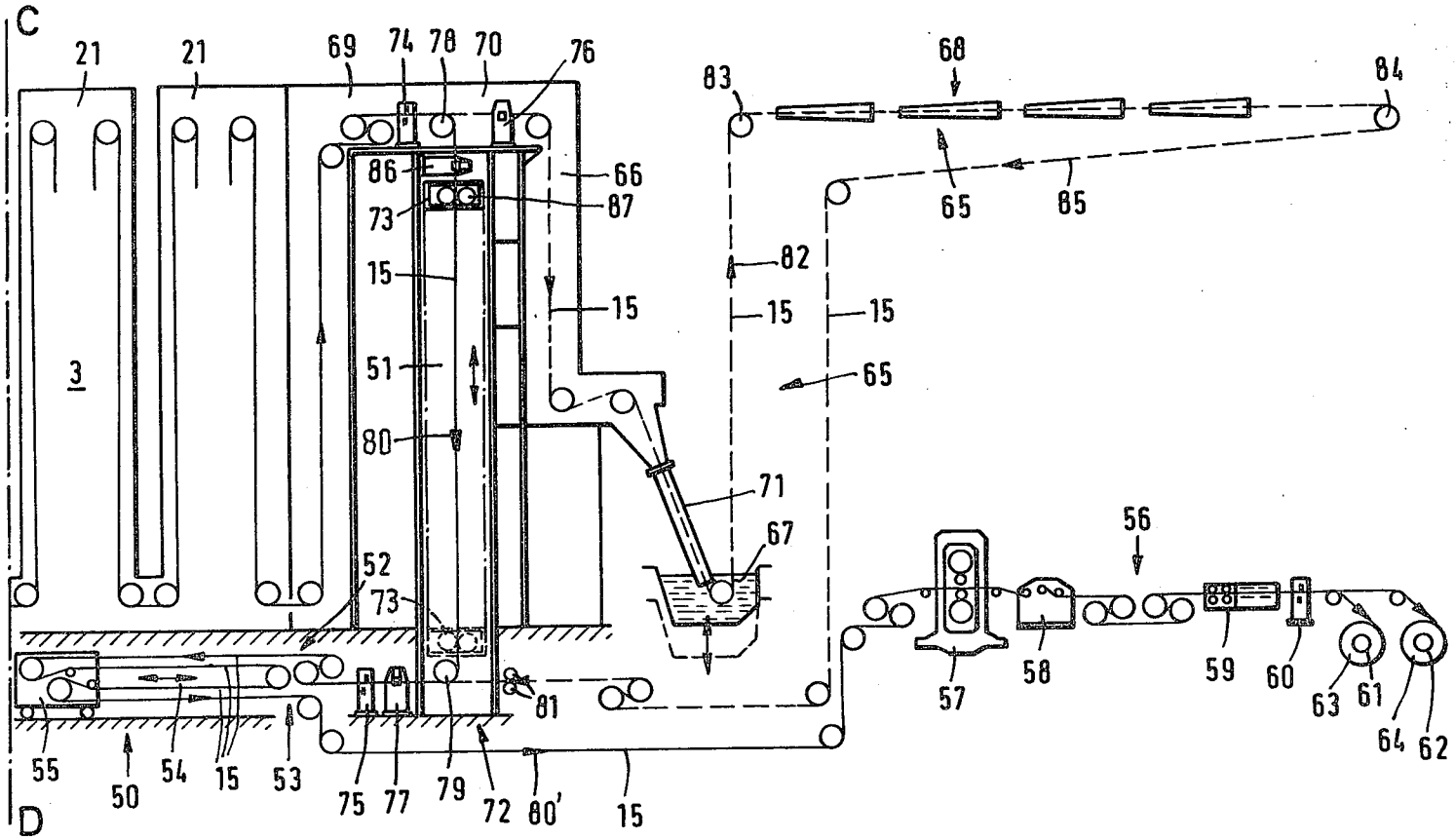

Station 50 in this second embodiment is located beneath annealing station 3 and has at one end 52 and at its other end 53 a plurality of fixed rollers about which the web is looped and between which a looping car 55 is provided which can travel in the direction of double arrow 54 to and from an end position shown at 55' (FIG. 2*a*).

A discharge station or discharge end 56 includes a plurality of after-treatment devices for web 15, such as a skin-pass mill stand 57, a stretch or leveling unit 58 and a chromizing after-treatment unit 59. A cross-cut shear 60, a pair of recoilers 61 and 62 for winding coils 63 and 64 thereon are located downstream of unit 59 and function in the same manner of that described with reference to elements 33 to 37 of FIG. 1.

A galvanizing station 65 includes a cooling section 66 and a zinc bath 67, as well as a cooling station 68. Elevator 51 for the threading web 15 is located between discharge end 69 of the annealing station and feed end 52 of web discharge storage station 50. At the end of the annealing station an extension 70 is provided as a branch section to galvanizing station 65 via a cooling section 66 and a snout 71 which extends into zinc bath 67.

Elevator 51, at the end of the annealing station, extends from discharge end 69 to mill floor level 72 a short distance downstream of end 69. A clamping and threading device 73 is mounted within elevator 51 for vertical movement in the direction of the double arrow by any suitable means, and comprises a pair of opposed rollers 87 for clamping the web which passes therebetween.

A cutting shear 74 is mounted at end 69 of the annealing station, and another cutting shear 75 is mounted just upstream of feed end 52 of station 50. A stitching or welding machine 76 is mounted in extension 70 of the galvanizing station, and another stitching or welding machine 77 is mounted just upstream of shear 75. Web 15 is cut by means of shears 75 and/or 74 when changing from web annealing to hot-dip coating, or vice-versa, immediately followed by interconnection of the strip ends by means of machines 77 and/or 76.

In this embodiment, when annealing a continuous metal web continuously for the first time, web 15 is alternately uncoiled from coils 7 and 8, passes through welding machine 11 and strip-cleaning devices 12, 13 and 14 and enters the web entry storage station 2. After several deflections therein, the web enters annealing station 3 at entry point 38. At the annealing station, it is first heated in section 19 to a normalization temperature of 950° C. maximum. This temperature is maintained approximately at such level in holding section 20, whereupon web 15 is cooled down in stages in section 21 to ambient temperature, for example 20° C. Web 15 then emerges from the annealing station at outlet 69 and is deflected over a roller 78 into elevator 51 and through an opposed pair of clamping rollers 87 of device for movement in the direction of arrow 80. At the lower end of the elevator the web is guided over a deflector roller 79 and enters station 50, from which it moves in the direction of arrow 80' through stand 57 and unit 58 and is rewound by recoilers 61 and 62 into reels 63, 64.

When changing from continuous annealing to hot-dip coating so as to combine these two operations, web 15 emerging from the annealing station is cross-cut by shear 74, and the trailing end of the web thus formed, lying within elevator 51, is clamped by unit 73 which moves to its lower position shown in dashed outline so as to transport this trailing end to the vicinity of machine 77 and is positioned there. Simultaneously, the leading end of the web produced by the cut at shear 74 is threaded into galvanizing station 65 through extension 70, cooling section 66, snout 71 and cooling section 68 and is guided into machine 77 by means of a pair of driven rolls 81. The two web ends are then interconnected by machine 77.

During the following first-time zinc-coating operation, web 15 which emerges from the annealing station is first passed through extension 70 and cooling section 66 and is then guided through snout 71 into hot zinc bath 67 with a temperature of about 450° C. From there, the web which is coated with zinc, is guided upwardly in the direction of arrow 82 and passes through cooling section 68 over roller 83. At the end of cooling section 68, the web which has been cooled down to ambient temperature, is guided over a deflector roller 84 in the direction of arrow 85 and into station 50 which is common to both the annealing and galvanizing operations. After emerging from the discharge storage station, the web is passed through the chromizing after-treatment device 59 before it is rewound in the same manner as aforedescribed.

When converting the operation from zinc coating to continuous annealing, the web is first cross-cut by shears 74 and 75. The trailing end of the web produced by the cut at machines 74 is then moved to stitching or welding machine 76, by some suitable means, and is retained therein. Similarly, the leading end of the strip produced by the cut at shear 75 is moved upstream a short distance by means of rollers 81 and is brought to a stop slightly ahead of these rollers. Then, the leading end of the web produced by the cut at shear 74 is moved by some suitable means about deflector roller 78 and into a stitching or welding machine 86 so as to be retained therein. In the meantime, clamping and threading device 73 is moved within the elevator in the direction of arrow 80 to its lower position shown in dashed outline. And, the trailing end of the web produced by the cut at shear 75 is guided by some suitable means around deflector roller 78 and between rollers 87 of device 73, the web being thus moved from storage 50. Device 73 is then moved upwardly in the elevator with the web being slackened from looping storage 50. When device 73 reaches its upper position shown in solid outline, the confronting ends for the web are interconnected by machine 86 whereafter the annealing operation may commence. During such time the cut section of web 15 remains in galvanizing station 65, with zinc bath 67 being lowered to a position shown in dashed outline to assure that the standing web portion remains out of contact with the hot zinc bath during the annealing operation.

When now changing from continuous annealing to hot-dip coating, web 15 is again cut transversely by shear 74 and the leading end of the web produced by this cut is then guided by some suitable means into stitching or welding machine 76 and is connected there with that end of the web, section which remained in the coating station as aforedescribed. At the same time, the trailing end of the web produce by the cut at the shear 74 is moved downwardly by device 73 in elevator 51 and is guided over deflector roller 79 in the direction of station 50 so as to be positioned in machine 77. Thereafter, the free end of the web section which had remained in the coating station is moved by means of rollers 81 into machine 77 so that the confronting ends thereat are interconnected. The continuous web may then now be again hot-dip coated.

From the foregoing it can be seen that a multi-purpose system has been devised making it possible to anneal a continuous metal web continuously for a predetermined period of time, and then to subject the web to a hot-dip coating operation, for example galvanizing, without interruption. Upon completion of the hot-dip coating operation, the system can be converted back solely for continuous annealing in conformity to the production program.

The requisite conditions for the multi-purpose system have the same technical design parameters, such as web dimensions, coil weights, web rates, annealing temperatures, etc., as for separate annealing and hot-dip coating operations. Discharge material, i.e., cold-rolled metal webs from a tandem mill, is likewise the same for both the annealing and hot-dip coating operations.

In order to change from one operation to the other, i.e. in order to again coat the web upon completion of the continuous annealing, the web need only be cut with a manually operated shear at the discharge end of the annealing station and, after the leading end of the web thereby formed is threaded by means of a hoist and chain as in FIG. 1 through the heating or cooling tower, the zinc snout and the hot-dip coating boiler, it is reconnected by welding to the trailing end formed by such cut at the discharge end of the annealing station.

Such a combined operation avoids the need to provide duplicate essential system units which are identical for both continuous annealing and for hot-dip coating, and contributes considerably to reducing operational and labor costs. Thus, a common annealing station is provided for both operations.

And, although the hot-dip coating station has been described as a hot-dip galvanizing station, it can likewise be designed as a hot-dip aluminizing station, a hot-dip tinning station, etc., without departing from the invention.

Also in accordance with the invention, a common discharge end is located downstream of the annealing station and of the hot-dip coating station thus assuring that, when changing from hot-dip coating to continuous annealing, the web covers the same distance to the recoilers.

In the FIG. 1 embodiment, extension channel 29 and web storage unit 27 are located between the annealing station and the hot-dip coating station, thereby enabling the coating station to be by-passed when converting solely to continuous annealing without having to operate the entire web feed end with the annealing station. A vertically movable storage roller 28 is designed for this purpose. During normal operation, this roller is located in its lowermost position outwardly of extension channel 29. It should be pointed out that "normal operation" is the customary operation of the present system, i.e., the operation carried out after the coupling and uncoupling procedures for the coating station have been completed.

When converting back to continuous annealing, the web is cut at the infeed end of the coating station by a manually operated shear at position 42", and is cut by a driven cutting shear 49 at the discharge end of the coating station. Thus, in extension channel 29 through which a protective gas flows and which, for example, during zinc coating, has a temperature of about 450° C., no further mechanical devices are provided, apart from the necessary transporting rollers 46.

And, when combining the coating operation, it is advantageous to design the systemm in such a manner that the leading end of the cut web be connected by manual welding to the trailing end of the strip section remaining in the coating section, and that the trailing end of the cut web and the leading end of the web section in the coating station be interconnected by a stitching or welding machine such as 47. The welding is carried out manually at the feed end of the coating station above the boiler pot, and at the discharge end of the coating station directly behind cutting shear 49.

In the FIG. 2 embodiment, the hot-dip coating station is disposed between the annealing station and the discharge storage station to facilitate a quick and easy coupling and uncoupling of the coating station. When changing for the first time from annealing to hot-dip coating, the web is cut at the discharge end of the annealing station, the leading end thereby produced is threaded through the coating station, the trailing end of the web thereby produced is lowered through an elevator and positioned at a stitching or welding machine at the feed end of the discharge storage station, the leading end is moved to this machine and interconnected with the other end thereof.

When converting the operation from hot-dip coating to continuous annealing, the web is cut at the discharge end of the annealing station and at the infeed end of the storage station and the respective leading and the trailing ends produced by the cuts are brought together and are interconnected. When again changing from continuous annealing to hot-dip coating, the web is cut at the discharge end of the annealing station and the leading and trailing ends produced by that cut are respectively connected with the free ends of the web section which had remained at the coating station from the previous conversion to continuous annealing.

And, in FIG. 2, a common web discharge storage station 50 is located downstream of the annealing and coating stations. Thus, when changing from hot-dip coating to continuous annealing, or vice-versa, the web supply required can be withdrawn from the storage station without having to actuate the units at the discharge end in a direction opposite the direction of web travel.

The cutting shears of FIG. 2 are located at the discharge end of the annealing station and at the entry end of the discharge storage station, and a stitching or welding machine is located at the inlet to the coating station and at the inlet to the discharge storage station, thus simplifying the conversion and reconversion treatment operations.

A web threading and clamping device movable within an upstanding elevator of FIG. 2 facilitates quick and easy conversion of the operations.

Obviously, many other modifications and variations of the present invention are made possible in the light of the above teachings. It is therefore to be understood that within the scope of the appended claims the invention may be practiced otherwise than as specifically described.

What is claimed is:

1. A system for the continuous and uninterrupted treatment of a continuous metal web, comprising an apparatus having a web feed station and a discharge station with an annealing station therebetween, a web entry storage station upstream of the annealing station in the direction of web travel, the discharge station including a web discharge storage station, means for continuously moving the web through said stations, whereby a continuous web annealing operation may be carried out, and a hot-dip coating station located between the anealing and discharge stations, means for selectively directing the web through the coating station for combining the annealing operation with a hot-dip web coating operation, and means for selectively by-passing the web from the coating station and directing the web into the discharge station to reconvert the combined annealing and coating operations solely into the web annealing operation, the means for by-passing the web and directing the web into the discharge station including means for severing the web between the annealing and coating stations to define a first leading web end and between the coating and discharge stations to define a first trailing web end, and means for joining the leading and trailing ends together.

2. A system for the continuous and uninterrupted treatment of a continuous metal web, comprising an apparatus having a web feed station and a discharge station with an annealing station therebetween, a web entry storage station upstream of the annealing station in the direction of web travel, a web discharge storage station upstream of the discharge station, means for continuously moving the web through said stations, whereby a continuous web annealing operation may be carried out, and a hot-dip coating station located between the annealing and web discharge storage stations, means for selectively directing the web through the coating station for combining the annealing operation with a hot-dip web coating operation, and means for selectively by-passing the web from the coating station and directing the web into the web discharge storage station to reconvert the combined annealing and coating operations solely into the web annealing operation, the means for by-passing the web and directing the web into the web discharge storage station including means for severing the web between the annealing and coating stations to define a first leading web end and between the coating and discharge storage stations to define a first trailing web end, and means for joining the leading and trailing ends together.

3. The system according to claim 1 or 2, wherein the hot-dip coating station comprises a hot-dip galvanizing means.

4. The system according to claim 1 or 2, wherein the hot-dip coating station comprises a hot-dip aluminizing means.

5. The system according to claim 1 or 2, wherein the hot-dip coating station comprises a hot-dip tinning means.

6. The system according to claim 1 or 2, wherein the hot-dip coating station includes a boiler pot containing a quantity of coating material into which the web is dipped, the apparatus including a channel extending between the annealing and coating stations for directing the web therethrough, and a web storage device between the annealing and coating stations for storing a length of web during the coating operation to facilitate joining the leading and trailing ends together while by-passing the coating station.

7. The system according to claim 6, wherein the web storage device includes an accumulator roller movable along a vertical path.

8. The system according to claim 7, wherein the roller is located beneath the web in the channel during the annealing operation.

9. The system according to claim 1, wherein said severing means include a manually operable cutting shear for severing the web between the annealing and coating stations, and a driven cutting shear for severing the web between the coating and discharge stations.

10. The system according to claim 1 or 2, wherein the means for directing the web through the coating station include means for severing the web between the annealing and coating sections, and means joining the several ends.

11. The system according to claim 2, wherein the severing means include driven shear members.

12. The system according to claim 10, wherein a movable web clamping device is located between the annealing and coating stations for guiding the trailing end of the web, upon severance, from one end of the coating station to the other to facilitate a joining of the several ends.

13. The system according to claim 12, wherein the clamping device comprises an opposed pair of rollers between which the web is clamped.

* * * * *